US008499473B2

(12) United States Patent
Dal Ben et al.

(10) Patent No.: US 8,499,473 B2
(45) Date of Patent: Aug. 6, 2013

(54) LAUNDRY DRYER WITH REAR WALL CAVITY

(75) Inventors: Diego Dal Ben, Zoppola (IT); Alessandro Vian, Meduna di Livenza (IT)

(73) Assignee: Electrolux Home Products Corporation, N.V., Brussels (BE)

( * ) Notice: Subject to any disclaimer, the term of this patent is extended or adjusted under 35 U.S.C. 154(b) by 179 days.

(21) Appl. No.: 13/208,431

(22) Filed: Aug. 12, 2011

(65) Prior Publication Data

US 2012/0047759 A1 Mar. 1, 2012

(30) Foreign Application Priority Data

Aug. 24, 2010 (EP) ..... 10173880

(51) Int. Cl.
*F26B 13/10* (2006.01)

(52) U.S. Cl.
USPC ..... 34/603; 34/607; 34/610; 68/24; 68/196; 8/137

(58) Field of Classification Search
USPC ..... 34/601, 603, 606, 610; 68/24, 32.2, 68/196; 8/137
See application file for complete search history.

(56) References Cited

U.S. PATENT DOCUMENTS

| | | | | |
|---|---|---|---|---|
| 2,752,694 | A * | 7/1956 | McCormick | 34/60 |
| 2,823,975 | A * | 2/1958 | Kirby | 8/159 |
| 2,827,276 | A * | 3/1958 | Racheter | 432/62 |
| 2,867,430 | A * | 1/1959 | Hullar | 432/107 |
| 3,034,223 | A * | 5/1962 | Lynch | 34/79 |
| 3,108,464 | A * | 10/1963 | Behrens | 68/19.2 |
| 3,358,302 | A * | 12/1967 | Candor | 8/159 |
| 3,385,085 | A * | 5/1968 | Engel | 68/18 F |
| 3,416,334 | A * | 12/1968 | Candor et al. | 68/20 |
| 3,436,934 | A * | 4/1969 | Stilwell, Jr. | 68/140 |
| 3,477,259 | A * | 11/1969 | Barrett et al. | 68/23.1 |
| 5,207,764 | A * | 5/1993 | Akabane et al. | 68/20 |
| 7,225,562 | B2 * | 6/2007 | Guinibert et al. | 34/601 |
| 7,694,434 | B2 * | 4/2010 | Lee | 34/607 |
| 7,946,054 | B2 * | 5/2011 | Dittmer et al. | 34/63 |
| 2005/0125910 | A1 * | 6/2005 | Guinibert et al. | 8/158 |
| 2005/0132603 | A1 | 6/2005 | Jeong et al. | |
| 2005/0268483 | A1 * | 12/2005 | Park et al. | 34/603 |
| 2006/0247145 | A1 * | 11/2006 | Guinibert et al. | 510/294 |
| 2012/0047759 | A1 * | 3/2012 | Ben et al. | 34/108 |
| 2012/0047760 | A1 * | 3/2012 | Dal Ben et al. | 34/108 |
| 2012/0060566 | A1 * | 3/2012 | Kim et al. | 68/140 |
| 2012/0090362 | A1 * | 4/2012 | Hwang et al. | 68/139 |

FOREIGN PATENT DOCUMENTS

| | | | |
|---|---|---|---|
| EP | 71312 | A1 * | 2/1983 |
| EP | 169604 | A2 * | 1/1986 |
| GB | 2129109 | A * | 5/1984 |

* cited by examiner

*Primary Examiner* — Steve M Gravini
(74) *Attorney, Agent, or Firm* — Banner & Witcoff, Ltd.

(57) ABSTRACT

An upper cabinet of a rotary-drum laundry dryer outer casing can include a rear wall. The rear wall can include a sink-shaped bulge or recess. The bulge or recess can project outwards of the upper cabinet, be roughly centered to a rear rim of a dryer drum, and include a through opening. The upper cabinet can also include a substantially circular, basin-shaped lid or cover fixed to the inner face of the cabinet rear wall substantially coaxial to the drum. The lid or cover can be shaped so as to completely cover and close the outwards-projecting bulge or recess on the cabinet rear wall. This can form, on that rear wall, a cavity which communicates with the inside of drum and also with a hot-air generator via the through opening.

16 Claims, 6 Drawing Sheets

LAUNDRY DRYER WITH REAR WALL CAVITY

CROSS-REFERENCE TO RELATED APPLICATION

This application claims priority to European Application No. 10173880.5 filed on Aug. 24, 2010.

FIELD

The present invention relates to a rotary-drum laundry dryer. More specifically, the present invention relates to a rotary-drum home laundry dryer, to which the following description refers purely by way of example without implying any loss of generality.

BACKGROUND

As is known, today's rotary-drum home laundry dryers comprise: a substantially parallelepiped-shaped outer boxlike casing structured for resting on the floor; a substantially cylindrical revolving drum structured for housing the laundry to be dried, and which is housed in axially rotating manner inside the casing to rotate about its horizontally-oriented longitudinal axis, directly facing a laundry loading/unloading opening formed in the front wall of the casing; a door hinged to the front wall of the casing to rotate to and from a closing position in which the door rests completely against the front wall of the casing to close the laundry loading/unloading opening and airtight seal the revolving drum; and an electrically-powered motor assembly structured for driving into rotation the revolving drum about its longitudinal axis inside the casing.

Home laundry dryers of the above type are also provided with an open-circuit or closed-circuit, hot-air generator which is structured to circulate inside the revolving drum a stream of hot air having a low moisture content, and which flows through the revolving drum and over the laundry inside the drum to rapidly dry the laundry; and with an electronic central control unit which controls both the motor assembly and the hot-air generator to perform one of the user-selectable drying cycles stored in the same central control unit.

In most of the rotary-drum home laundry dryers currently on the market, the revolving drum has a substantially cylindrical, sleeve-shaped structure and consists in a substantially cylindrical, rigid tubular body which is structured for resting horizontally inside the appliance casing aligned to the laundry loading/unloading opening, on a number of horizontally-oriented supporting rollers which are located at the two axial ends of the tubular body, and are fixed to the appliance casing in free revolving manner so to allow the tubular body to freely rotate about its horizontally-oriented longitudinal axis.

The front rim of the tubular body surrounds the laundry loading/unloading opening and is coupled in airtight and axially rotating manner to the front wall of the appliance casing; whereas the rear rim of the tubular body abuts against the rear wall of the appliance casing and is coupled in airtight and axially rotating manner directly to said rear wall.

In particular, to avoid air leakages from the two axial ends of the tubular body, a first annular sealing gasket is interposed between the front rim of the tubular body and the front wall of the casing, and a second annular sealing gasket is interposed between the rear rim of the tubular body and the rear wall of the appliance casing.

The hot air is channeled into the tubular body via a through opening which is realized in the rear wall of the appliance casing, and which is connected to the outlet of the hot air generator via an air duct located on the back of the appliance casing. This air duct, in turn, is covered by a protective back panel firmly fixed to the rear wall of the appliance casing.

US patent application No. 2005/0132603 discloses a rotary-drum home laundry dryer having this particular structure.

Despite allowing a cost effective production of the laundry dryers, the sleeve-shaped structure of the revolving drum causes lots of problems during the on-site maintenance of the household appliance. Inspection of the rear part of the rotary-drum laundry dryer, in fact, is relatively difficult and lengthy because several elements are firmly fixed to the rear wall of the appliance casing and must be removed to grant access to the back of the revolving drum.

SUMMARY

Aim of the present invention is to simplify the structure of today's rotary-drum home laundry dryers to simplify on-site maintenance and to eliminate other drawbacks.

In compliance with the above aims, according to the present invention there is provided a rotary-drum laundry dryer comprising an outer casing, a drum structured for housing the laundry to be dried and which is rotatably arranged inside the casing, and a hot-air generator which is structured to circulate a stream of hot air through said revolving drum; the outer casing in turn comprising:

- a lower supporting base or socle which is structured for resting on the floor; and
- an upper boxlike cabinet which is structured for rigidly resting on the lower supporting base or socle and for housing the sleeve-shaped revolving drum;

the drum comprising a substantially cylindrical, rigid tubular body which extends inside the upper boxlike cabinet immediately above the supporting base or socle, has its front rim rotatably coupled to a front bulkhead of the upper cabinet and its rear rim rotatably coupled to the rear wall of the upper cabinet, and rests on a number of front and rear supporting rollers; the rotary-drum laundry dryer being characterized in that the rear wall of the upper cabinet is provided with a sink-shaped bulge or recess which projects outwards of the cabinet, is roughly centered to the rear rim of the rigid tubular body and is provided with a through opening; and in that the upper cabinet also comprises a substantially circular, basin-shaped lid or cover which is fixed to the inner face of the rear wall of the cabinet substantially coaxial to the tubular body, and is dimensioned/shaped so as to completely cover and close the outwards-projecting bulge or recess on the rear wall of the cabinet, so as to form, on said rear wall, a cavity which communicates with the inside of the revolving drum and also with the hot-air generator via said through opening realized on the outwards-projecting bulge or recess.

Furthermore and preferably, though not necessarily, the lower supporting base or socle is provided with an air vent which is located below the rear wall of the upper cabinet and is structured for channeling out of the lower supporting base or socle an airflow; the upper cabinet also comprising a substantially basin-shaped half-shell which is fixed to the outer face of the rear wall of the upper cabinet so as to form, together with the rear wall of the cabinet, a connecting duct which channels directly into said through opening the dehumidified airflow coming out of the air vent.

Furthermore and preferably, though not necessarily, the hot-air generator is a closed-circuit, hot-air generator which comprises:

an air recirculating conduit having its two ends connected to the revolving drum on opposite sides of the latter;

air circulating means which are located along the air recirculating conduit and are structured to produce, inside the air recirculating conduit, an airflow which flows through the revolving drum and over the laundry inside the drum;

air cooling means which are located along the air recirculating conduit and are structured to rapidly cool the moist air arriving from the revolving drum so as to cause condensation of the surplus moisture inside the airflow; and air heating means which are located along the air recirculating conduit, downstream of the air cooling means, and which are structured for rapidly heating the dehumidified airflow arriving from the air cooling means and directed back to the revolving drum;

at least the air cooling means of the hot air-generator being housed inside the lower supporting base or socle.

Furthermore and preferably, though not necessarily, the air heating means of said hot-air generator are located alternatively inside the connecting duct formed by the basin-shaped half-shell and the rear wall of the cabinet, or inside the lower supporting base or socle.

Furthermore and preferably, though not necessarily, the air heating means of the hot-air generator comprises a resistor which is stably located inside of the connecting duct formed by the basin-shaped half-shell and the rear wall of the upper cabinet.

Furthermore and preferably, though not necessarily, at least the rear supporting rollers are fixed, in free revolving manner, to the supporting base or socle so that the rear wall is free from any supporting rollers for the drum.

Furthermore and preferably, though not necessarily, the upper cabinet comprises a first circular sealing gasket which is interposed between the front rim of the tubular body and the front wall of the cabinet, and a second circular sealing gasket which is interposed between the rear rim of the tubular body and the rear wall of the cabinet.

Furthermore and preferably, though not necessarily, the upper cabinet also comprises a circular gasket-supporting collar which has a nominal diameter greater than that of the rear rim of the tubular body, and is fixed to the periphery of the basin-shaped lid or cover and/or to the rear wall of the cabinet, coaxial to said tubular body; the second circular sealing gasket being force fitted into the gasket-supporting collar so as to permanently come in abutment against the periphery of the basin-shaped lid or cover without interruption all around the perimeter of the latter.

Furthermore and preferably, though not necessarily, the outwards-projecting sink-shaped bulge or recess is substantially circular in shape, has an outer diameter lower than that of the rear rim of the tubular body, and protrudes outwards of the upper cabinet while remaining substantially coaxial to the longitudinal axis of the tubular body.

Furthermore and preferably, though not necessarily, the basin-shaped lid or cover is fixed to the rear wall of the upper cabinet with its concavity directly facing the bottom of the outwards-projecting bulge or recess on the rear wall of the cabinet, so as to form, on said rear wall, a substantially lenticular-shaped cavity.

Furthermore and preferably, though not necessarily, the basin-shaped lid or cover is firmly fixed to the rear wall of the upper cabinet in substantially airtight manner.

Furthermore and preferably, though not necessarily, an annular sealing gasket is interposed between the basin-shaped lid or cover and the rear wall of the upper cabinet.

Furthermore and preferably, though not necessarily, at least a portion of the basin-shaped lid or cover is properly perforated, or at any rate permeable to air, to permit hot air to flow into the revolving drum or vice versa.

Furthermore and preferably, though not necessarily, the central section of the bottom of the basin-shaped lid or cover is provided with a substantially cup-shaped contra-oriented bulge or recess which projects towards the bottom of the outwards-projecting bulge or recess on the rear wall of the upper cabinet.

Furthermore and preferably, though not necessarily, the periphery of the basin-shaped lid or cover is fixed to the rear wall of the upper cabinet via seam-folding and/or clinching and/or riveting and/or spot-welding or similar.

Furthermore and preferably, though not necessarily, the circular gasket-supporting collar is fixed to the periphery of the basin-shaped lid or cover and/or to the rear wall of the upper casing via seam-folding and/or clinching and/or riveting and/or spot-welding or similar.

Furthermore and preferably, though not necessarily, the circular gasket-supporting collar is realized in one piece with the basin-shaped lid or cover.

Furthermore and preferably, though not necessarily, the second circular sealing gasket consists of a monolithic, toroidal-shaped ring made of rubber or other elastomeric polymer suitable to be force fitted into the circular gasket-supporting collar.

Furthermore and preferably, though not necessarily, the basin-shaped lid or cover and/or the circular gasket-supporting collar are made of metal material.

BRIEF DESCRIPTION OF THE DRAWINGS

A non-limiting embodiment of the present invention will now be described, by way of example, with reference to the accompanying drawings, in which:

FIG. 6 shows a partly-exploded isometric view of the rear wall of the FIG. 1 rotary-drum home laundry dryer with parts removed for clarity; whereas

DETAILED DESCRIPTION OF EXAMPLE EMBODIMENTS

Figure 1:
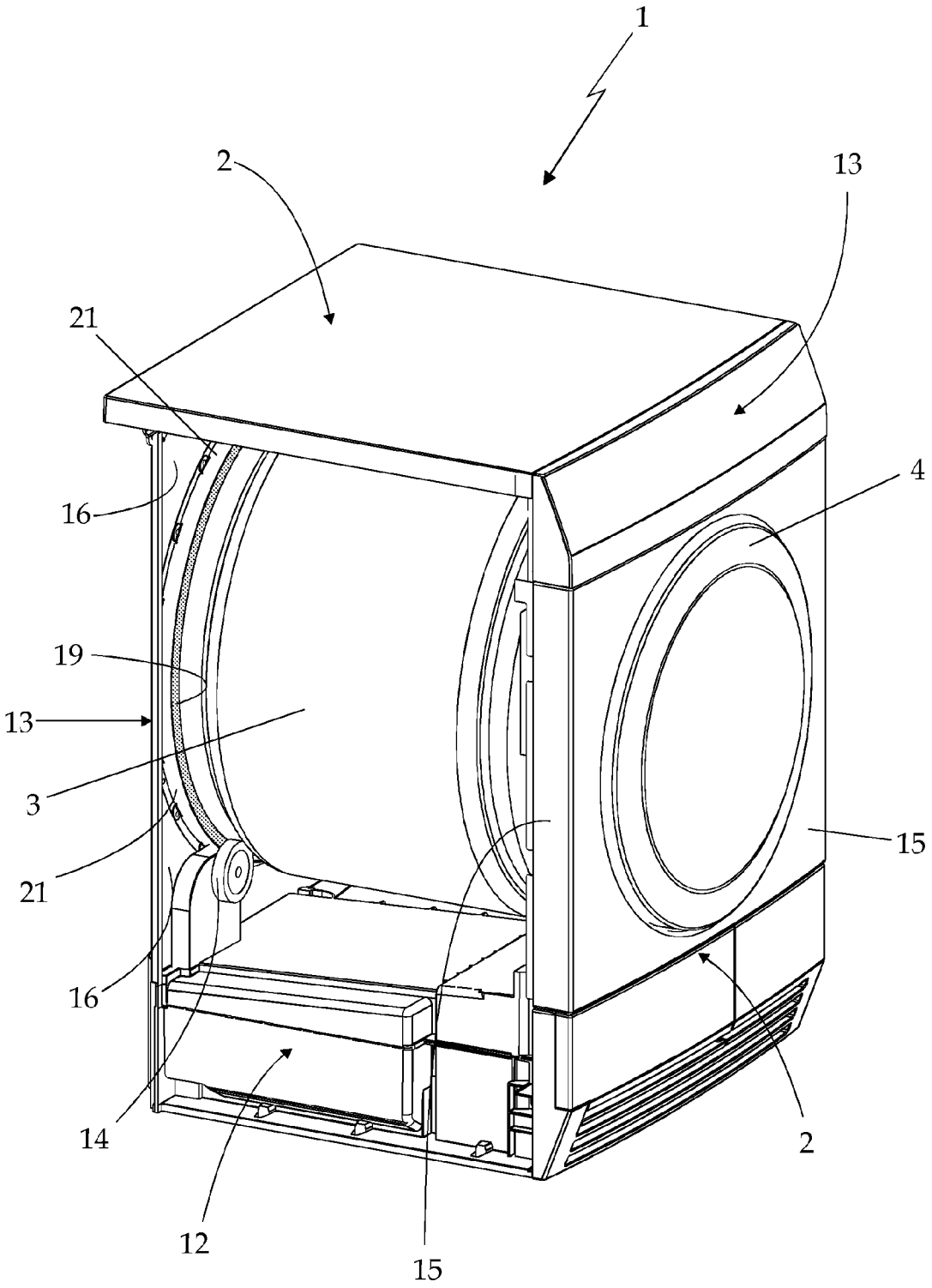
FIG. 1 shows an isometric view, with parts removed for clarity, of a rotary-drum home laundry dryer realized in accordance with the teachings of the present invention.
Figure 2:
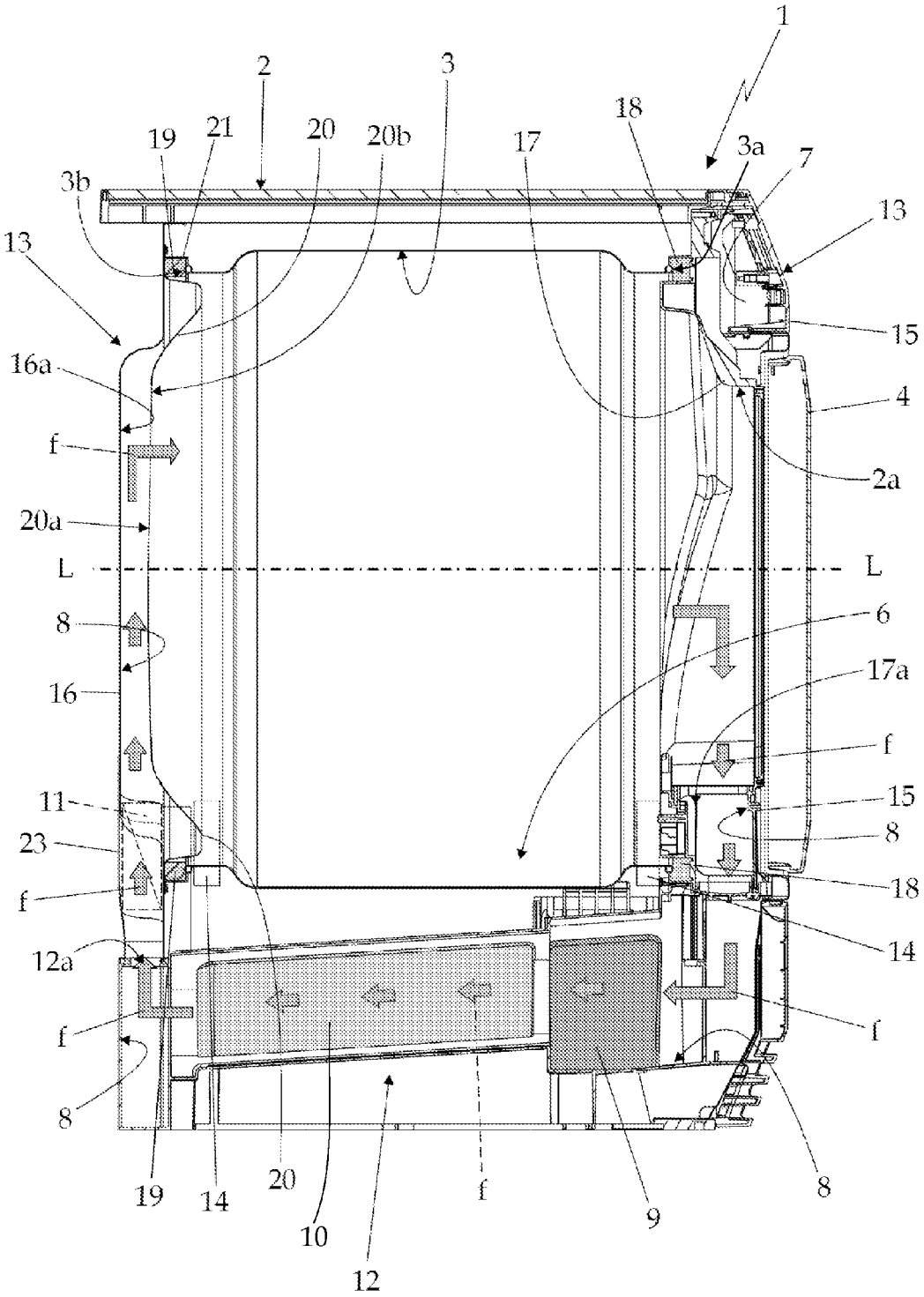
FIG. 2 shows a section view of the FIG. 1 rotary-drum home laundry dryer with parts removed for clarity.

With reference to FIGS. 1 and 2, number 1 indicates as a whole a rotary-drum home laundry dryer which comprises: a preferably, though not necessarily, parallelepiped-shaped outer boxlike casing 2 structured for resting on the floor; a substantially cylindrical, sleeve-shaped revolving drum 3 structured for housing the laundry to be dried, and which is fixed in axially rotating manner inside outer casing 2, directly facing a laundry loading/unloading through opening 2*a* formed in the front wall of casing 2; and a porthole door 4 hinged to the front wall of casing 2 to rotate about a preferably, though not necessarily, vertically-oriented reference axis, to and from a closing position in which door 4 rests completely against the front wall to close the laundry loading/unloading opening 2*a* and airtight seal the revolving drum 3.

Inside casing 2, the rotary-drum home laundry dryer 1 additionally comprises an electrically-powered motor assembly (not shown) structured for driving into rotation, on command, the revolving drum 3 about its longitudinal axis; an open-circuit or closed-circuit, hot-air generator 6 which is structured to circulate through revolving drum 3, on command, a stream of hot air having a low moisture level, and which flows over and rapidly dries the laundry located inside drum 3; and finally an electronic central control unit 7 which controls both the electrically-powered motor assembly and the hot-air generator 6 to perform, on command, one of the user-selectable drying cycles preferably, though not necessarily, stored in the same central control unit.

Preferably, with reference to FIG. 2, hot-air generator 6 is a closed-circuit, hot-air generator which is structured for gradually drawing air from revolving drum 3; cooling down the air arriving from revolving drum 3 so to extract and retain the surplus moisture in the air drawn from revolving drum 3; heating the dehumidified air to a predetermined temperature, normally higher than the temperature of the air from revolving drum 3; and feeding the heated, dehumidified air back into the revolving drum 3, where it flows over, to rapidly dry, the laundry inside the drum.

In other words, hot-air generator 6 provides for continually dehumidifying and heating the air circulating inside revolving drum 3 to rapidly dry the laundry inside the drum, and substantially comprises:

- an air recirculating conduit 8, the two ends of which are connected to the revolving drum 3 on opposite sides of the latter;
- an electrically-powered centrifugal fan 9 or other type of air circulating pump, which is located along recirculating conduit 8 to produce, inside recirculating conduit 8, an airflow f which flows through revolving drum 3 and over the laundry inside drum 3;
- air cooling means 10 which are located along the air recirculating conduit 8 preferably, though not necessarily, downstream of the centrifugal fan 9, and are structured to rapidly cool the moist air arriving from revolving drum 3 so as to cause condensation of the surplus moisture inside the airflow f; and
- air heating means 11 which are located along the air recirculating conduit 8, downstream of the air cooling means 10, and which are structured for rapidly heating the dehumidified airflow f arriving from the air cooling means 10 and directed back to revolving drum 3, so that the airflow f directed back into revolving drum 3 is heated to a temperature preferably, though not necessarily, higher than or equal to that of the moist air flowing out of revolving drum 3.

With reference to FIGS. 1-5, in particular, outer casing 2 comprises a substantially parallelepiped-shaped lower supporting base or socle 12 which is structured for resting on the floor and optionally for housing part of hot-air generator 6; and a substantially parallelepiped-shaped upper boxlike cabinet 13 which, in turn, is structured for rigidly and unmovably resting on the lower supporting base or socle 12 and for housing the sleeve-shaped revolving drum 3.

The lower supporting base or socle 12 is preferably, though not necessarily, structured for housing an intermediate section of the air recirculating conduit 8, the air cooling means 10 and the centrifugal fan 9 of hot-air generator 6.

Revolving drum 3, in turn, extends inside boxlike cabinet 13 immediately above the supporting base or socle 12, and comprises a substantially cylindrical, rigid tubular body 3 which extends coaxial to a substantially horizontally-oriented longitudinal axis L, and rests on a number of substantially horizontally-oriented, front and rear supporting rollers 14 which are located at the two axial ends of the tubular body 3 so to allow the tubular body 3 to freely rotate inside boxlike cabinet 13 about longitudinal axis L. Preferably the rear supporting rollers 14 are fixed directly to the top of the supporting base or socle 12 in free revolving manner, i.e. the shaft of each rear roller 14 is coupled directly to the supporting base or socle 12 so that rear wall 16 is free from any supporting rollers for the drum. Preferably also the front supporting rollers 14 are fixed directly to the top of the supporting base or socle 12.

In the example shown, tubular body 3 is preferably, though not necessarily, made of metal material such as, for example, stainless steel.

With reference to FIGS. 1, 2, 4 and 5, the laundry loading/unloading opening 2*a* of casing 2 is therefore realized in the front wall 15 of cabinet 13, and front rim 3*a* of tubular body 3 is coupled in substantially airtight manner and in axially rotating manner to front wall 15 of cabinet 13 so as to surround the laundry loading/unloading opening 2*a*; whereas the rear rim 3*b* of tubular body 3 is coupled in substantially airtight manner and in axially rotating manner to the rear wall 16 of cabinet 13.

Hot-air generator 6, in turn, is structured so that the stream of hot air produced by the latter preferably, though not necessarily, enters into revolving drum 3 through the mouth delimited by the rear rim 3*b* of tubular body 3, and leaves revolving drum 3 through the mouth delimited by the front rim 3*a*.

With reference to FIG. 2, the front rim 3*a* of tubular body 3 is preferably, though not necessarily, coupled in airtight and axially rotating manner to a bulkhead which, in the example shown, can comprise a substantially funnel-shaped element 17 which is rigidly fixed to the front wall 15 of cabinet 13, immediately above the supporting base or socle 12 and between front wall 15 and tubular body 3, and which is provided with a funnel-shaped central through opening aligned to the laundry loading/unloading opening 2*a* on front wall 15 of cabinet 13. This funnel-shaped element 17 is also provided with a substantially vertically-oriented internal duct 17*a* which extends from the funnel-shaped central through opening of element 17 up to the supporting base or socle 12 located immediately beneath, so as to put front rim 3*a* of tubular body 3 in direct communication with the suction of the centrifugal fan 9 of hot-air generator 6.

In other words, internal duct 17*a* is structured to channel the moist air out of tubular body 3 and towards the suction of the centrifugal fan 9, and therefore forms a first section of the air recirculating conduit 8.

Rear rim 3*b* of tubular body 3, instead, is coupled in airtight and axially rotating manner directly to rear wall 16 of cabinet 13, and the stream of hot air produced by hot-air generator 6 reaches the rear rim 3*b* via a through opening realized in rear wall 16.

Figure 3:
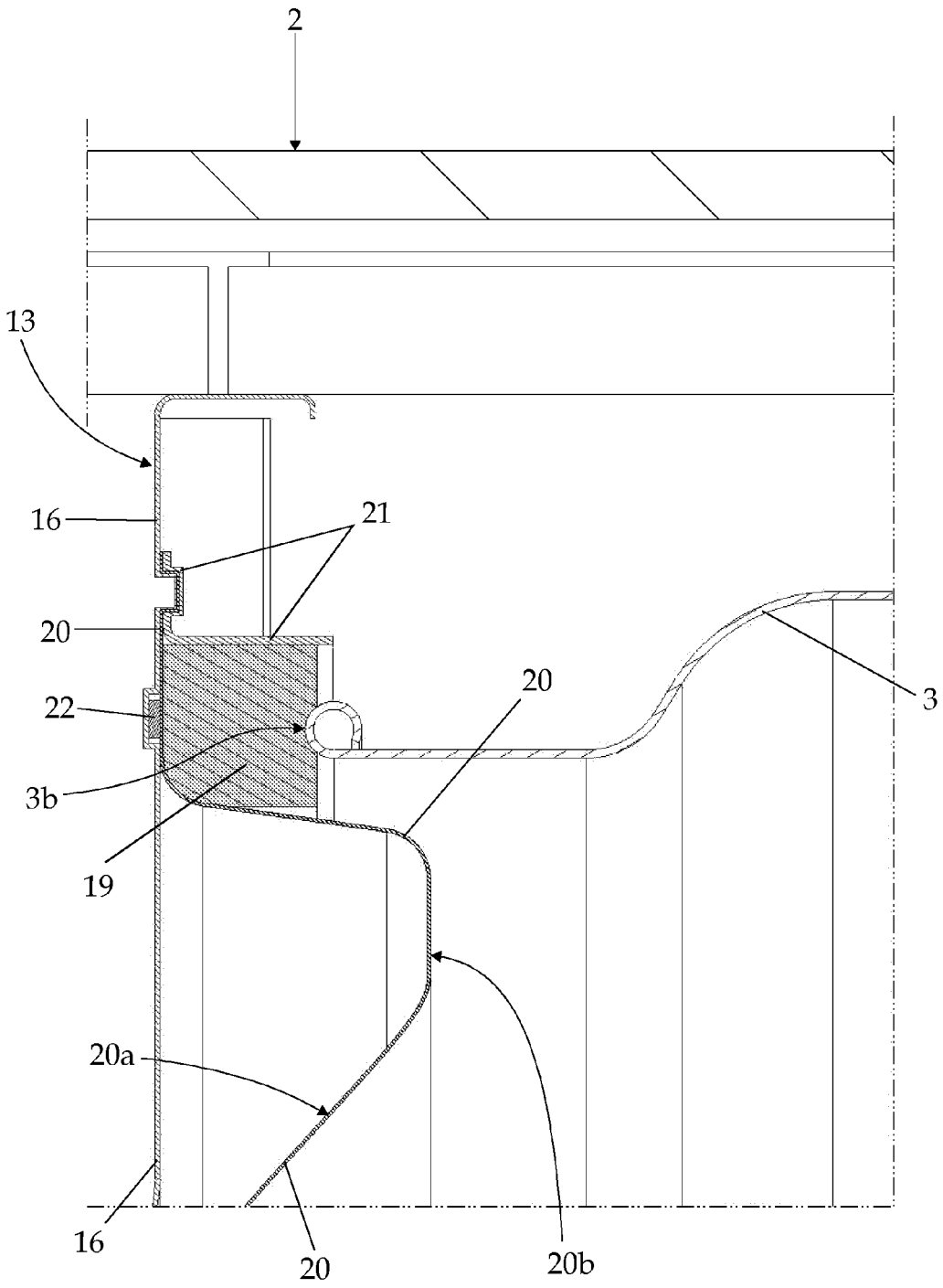
FIG. 3 shows an enlarged view of a portion of the FIG. 2 rotary-drum home laundry dryer, with parts in section and parts removed for clarity.
Figure 4:
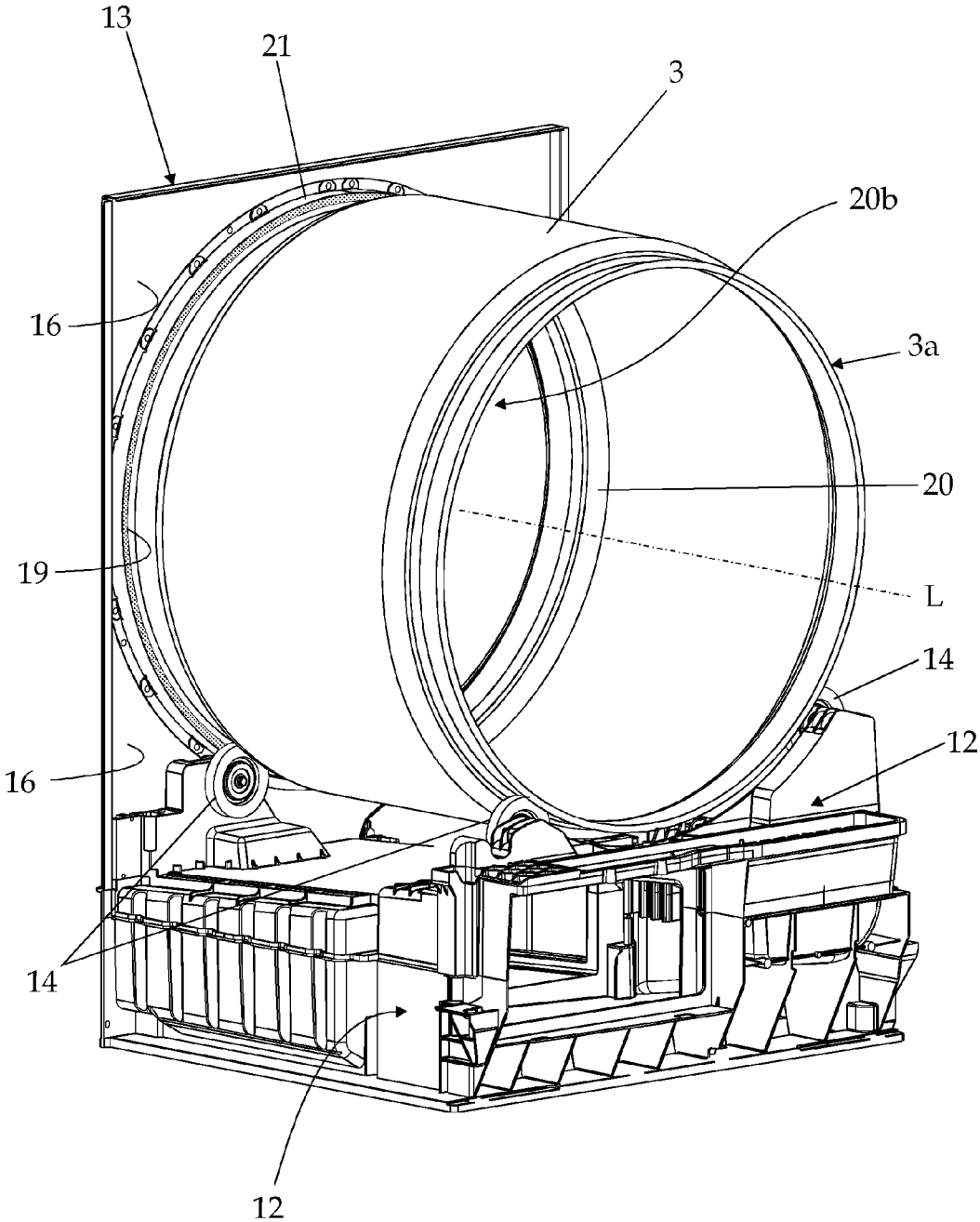
FIG. 4 shows an isometric view of the inside of the FIG. 1 rotary-drum home laundry dryer, with parts removed for clarity.

With reference to FIGS. 2 and 3, the upper cabinet 13 is also provided with two circular sealing gaskets 18 and 19 which are located at the two axial ends of tubular body 3 to avoid air leakages from the latter. Circular sealing gasket 18 is interposed between front rim 3*a* of tubular body 3 and the funnel-shaped element 17, is coaxial to tubular body 3, and substantially copies the nominal diameter of front rim 3*a* of tubular body 3. Circular sealing gasket 19, in turn, is interposed between rear rim 3*b* of tubular body 3 and the rear wall 16 of cabinet 13, is coaxial to tubular body 3 and substantially copies the nominal diameter of the rear rim 3*b* of tubular body 3.

In the example shown, in particular, circular sealing gasket 18 is preferably, though not necessarily, stationary recessed into a circular groove which is realized on the body of funnel-shaped element 17 so as to be directly faced and coaxial to front rim 3*a* of revolving drum 3; whereas circular sealing gasket 19 is firmly fixed to the rear wall 16 of cabinet 13.

As regards the upper boxlike cabinet 13, with reference to FIGS. 2-7, the rear wall 16 of cabinet 13 is provided with a sink-shaped bulge or recess 16*a* which projects outwards cabinet 13 while remaining roughly centered to the rear rim 3*b* of tubular body 3. The sink-shaped bulge or recess 16*a* is moreover provided, roughly on the bottom, with a through opening 16*b* which is faced to the supporting base or socle 12 located immediately beneath.

Preferably, the through opening 16*b* on the bottom of the sink-shaped bulge or recess 16*a* is aligned to an outwards-projecting air vent 12*a* which forms the end of the air recirculating conduit 8 intermediate section that extends inside the lower supporting base or socle 12. Preferably, the outwards-projecting air vent 12*a* protrudes from the lower supporting base or socle 12 immediately below and beyond the lower edge of the rear wall 16 of cabinet 13.

In other words, the air vent 12*a* forms the end of the intermediate section of the air recirculating conduit 8, and it is structured for channeling out of the lower supporting base or socle 12 the dehumidified airflow f flowing along the intermediate section of the air recirculating conduit 8 after having crossed at least the air cooling means 10 of hot-air generator 6.

In the example shown, in particular, the outwards-projecting sink-shaped bulge or recess 16*a* is preferably, though not necessarily, substantially circular in shape, has an outer diameter lower than that of sealing gasket 19 and of rear rim 3*b*, and protrudes outwards cabinet 13 while remaining substantially coaxial to longitudinal axis L of tubular body 3, so as to be located inside the perimeter of circular sealing gasket 19 and rear rim 3*b*.

With reference to FIGS. 2, 3, 5 and 7, the upper boxlike cabinet 13 also comprises a substantially circular, dish- or basin-shaped lid or cover 20 which is firmly fixed to the inner face of the rear wall 16 of cabinet 13 substantially coaxial to the longitudinal axis L of tubular body 3, and is dimensioned/shaped so as to completely cover and close the outwards-projecting bulge or recess 16*a* of rear wall 16 to form an air duct or passageway for the hot air directed towards revolving drum 3; and, preferably, a circular gasket-supporting collar 21 which has a nominal diameter greater than that of rear rim 3*b*, and is firmly fixed to the periphery of the basin-shaped lid or cover 20, and/or to the rear wall 16 of cabinet 13, so as to be coaxial to the longitudinal axis L of tubular body 3.

Both the basin-shaped lid or cover 20 and the gasket-supporting collar 21 are preferably, though not necessarily, made of metal material.

Preferably, basin-shaped lid or cover 20 is firmly fixed to rear wall 16 of cabinet 13 in substantially airtight manner, with its concavity directly facing the bottom of the outwards-projecting bulge or recess 16*a* of rear wall 16, so as to form, on rear wall 16 of the cabinet, a substantially lenticular-shaped cavity which is suited to receive the hot air arriving from hot-air generator 6; whereas at least a portion of the bottom 20*b* of the basin-shaped lid or cover 20 is properly perforated, or at any rate permeable to air, to permit hot air to flow into revolving drum 3 or vice versa.

The circular sealing gasket 19 is force fitted into gasket-supporting collar 21, and is shaped so as to permanently come in abutment against the periphery of the basin-shaped lid or cover 20 without interruption all around the perimeter of the latter, so as to avoid any air leakage from the gap between the rear rim 3*b* of tubular body 3 and the basin-shaped lid or cover 20.

Additionally, the circular sealing gasket 19 may also be shaped so as to take up the volume of the annular groove delimited by the gasket-supporting collar 21 and the basin-shaped lid or cover 20. In other words, the circular sealing gasket 19 optionally may also be force fitted onto the cylindrical sidewall of the basin-shaped lid or cover 20.

In the example shown, in particular, the circular sealing gasket 19 preferably, though not necessarily, consists of a monolithic, toroidal-shaped ring 19 made of rubber or other elastomeric polymer suitable to be force fitted into the circular gasket-supporting collar 21. Optionally, the toroidal-shaped ring 19 may also have a hollow structure, particularly when made of rubber or other elastomeric polymer.

Figure 7:
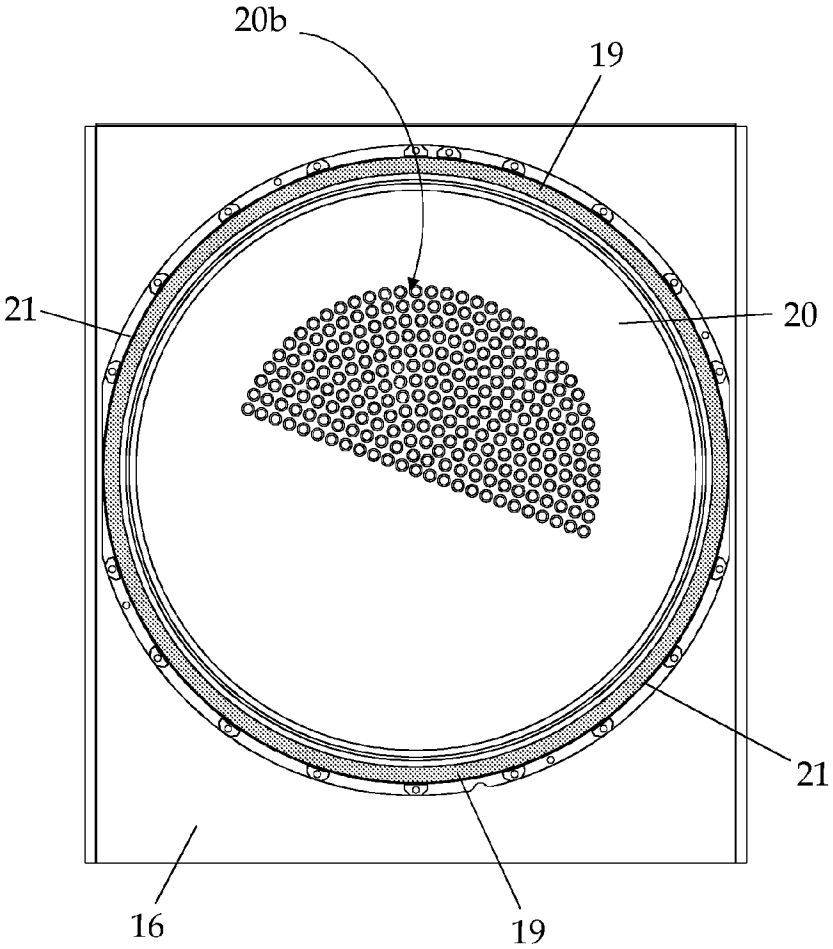
FIG. 7 shows a front view of the rear wall of the FIG. 1 rotary-drum home laundry dryer, with parts removed for clarity.

With reference to FIGS. 3 and 7, in the example shown, moreover, the periphery of the basin-shaped lid or cover 20 is permanently fixed to the rear wall 16 of cabinet 13 preferably, though not necessarily, via seam-folding and/or clinching and/or riveting and/or spot-welding or similar; and an annular sealing gasket 22 is preferably, though not necessarily, interposed between the basin-shaped lid or cover 20 and the rear wall 16 of cabinet 13 to avoid undesired air leakages from the substantially lenticular-shaped cavity formed on rear wall 16. Obviously the sealing gasket 22 surrounds the entrance or mouth of the outwards-projecting bulge or recess 16*a* on rear wall 16.

Figure 6:
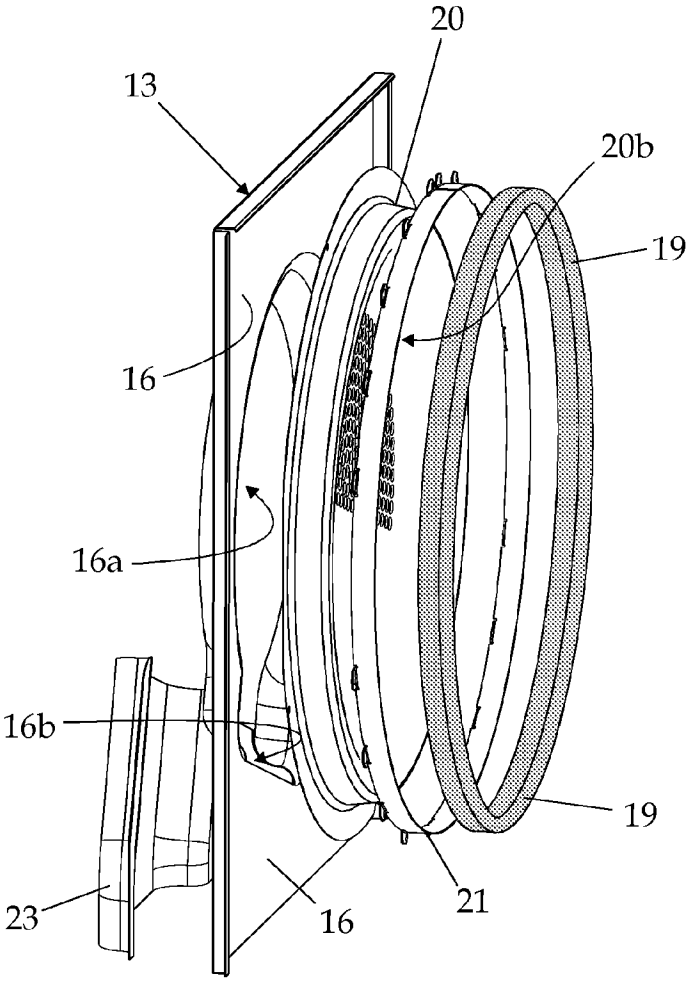

Moreover, with reference to FIGS. 2, 3 and 6, in the example shown the central section of the bottom 20*b* of the basin-shaped lid or cover 20 is preferably, though not necessarily, provided with a substantially circular, cup-shaped contra-oriented bulge or recess 20*a* which projects towards the bottom of the outwards-projecting bulge or recess 16*a* of rear wall 16, so to locally reduce the thickness of the lenticular-shaped cavity formed on rear wall 16 and maximize the inner volume of revolving drum 3. Thus the basin-shaped lid or cover 20 has a substantially U-shaped peripheral annular portion which protrudes inside the revolving drum 3, and a substantially cup-shaped central portion which stick out of revolving drum 3 and protrudes inside the outwards-projecting bulge or recess 16*a* of rear wall 16.

The perforated area of the basin-shaped lid or cover 20 is preferably, though not necessarily, located on the bottom of said contra-oriented bulge or recess 20*a*.

As regards the circular gasket-supporting collar 21, with reference to FIGS. 3, 4, 6 and 7, the rear rim of gasket-supporting collar 21—i.e. the rim of collar 21 faced to rear wall 16—is provided with one or more radially outwards-projecting winglet or flanges, which are structured to be permanently fixed to the periphery of the basin-shaped lid or cover 20 and/or optionally also to the rear wall 16 of cabinet 13 via seam-folding and/or clinching and/or riveting and/or spot-welding or similar, so as to firmly fix the gasket-supporting collar 21 on the periphery of the basin-shaped lid or cover 20, while remaining coaxial to the longitudinal axis L of tubular body 3.

Figure 5:
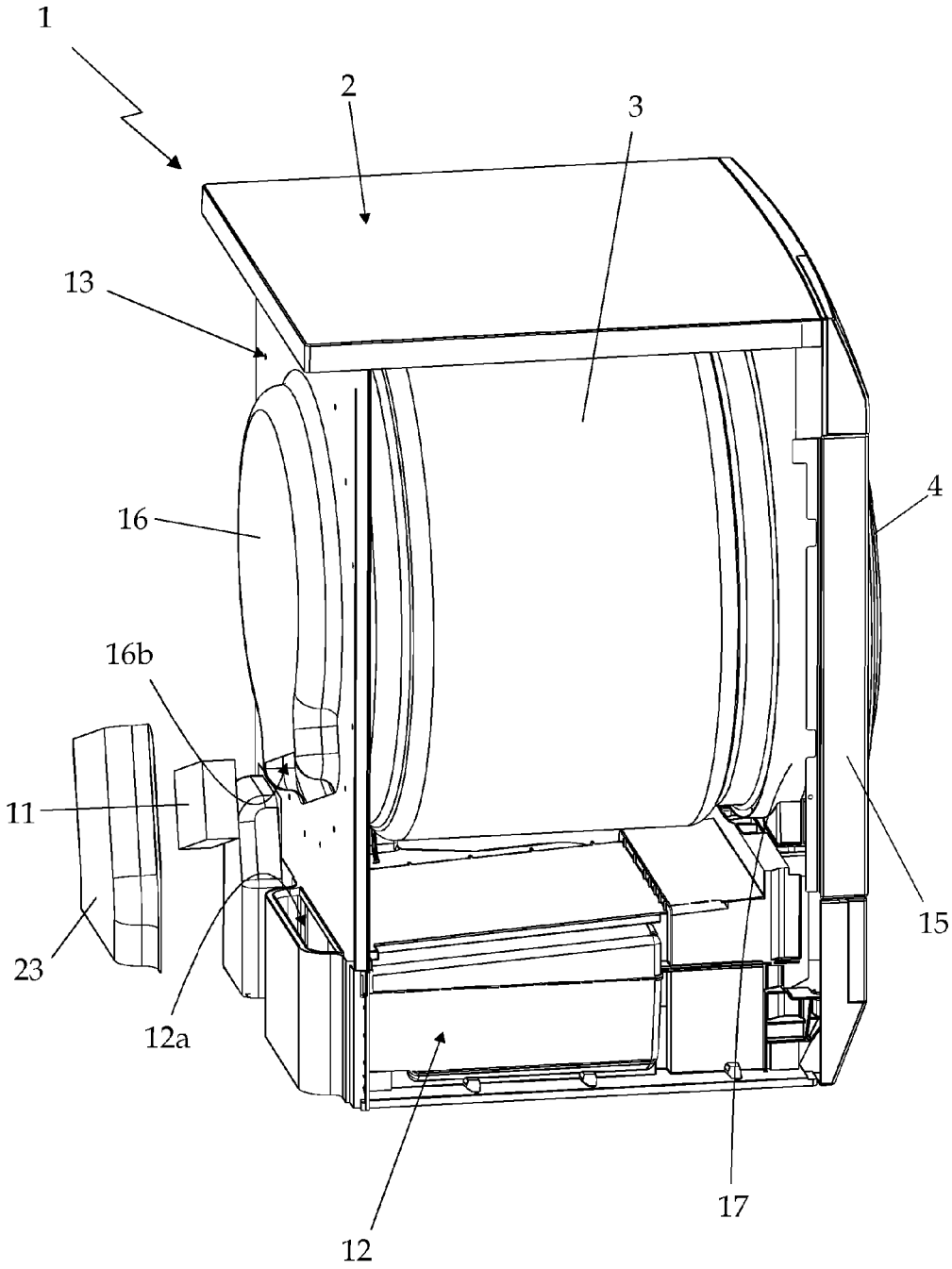
FIG. 5 shows a partly-exploded isometric view of the FIG. 1 rotary-drum home laundry dryer with parts removed for clarity.

With reference to FIGS. 2, 5 and 6, additionally the upper boxlike cabinet 13 comprises a substantially basin-shaped half-shell 23 which is rigidly fixed, in upside-down position, to the outer face of rear wall 16, immediately above the through opening 16*b* on the bottom of the sink-shaped bulge or recess 16*a* and above the air vent 12*a* on the lower supporting base or socle 12, so as to form, together with rear wall 16 of cabinet 13, a connecting duct which puts opening 16*b* in direct communication with the air vent 12*a*, so as to channel directly into opening 16*b* the dehumidified airflow f which flows along the intermediate section of the air recirculating conduit 8 after having crossed the air cooling means 10 housed into the lower supporting base or socle 12. The connecting duct formed by the basin-shaped half shell 23 and the rear wall 16 is a part of the air circulating conduit 8.

The substantially lenticular-shaped cavity formed by the basin-shaped lid or cover 20 and the outwards-projecting bulge or recess 16*a* on the rear wall 16 of the cabinet, therefore, communicates with hot-air generator 6 via the through opening 16*b* realized on the bottom of the outwards-projecting bulge or recess 16*a*.

Alike the basin-shaped lid or cover 20 and the gasket-supporting collar 21, basin-shaped half-shell 23 is preferably, though not necessarily, made of metal material.

With reference to FIGS. 2 and 5, depending on the type of hot-air generator installed into the rotary-drum home laundry dryer 1, the inside of the air duct formed by the basin-shaped half-shell 23 and the rear wall 16 of cabinet 13, may be used for stably housing the air heating means 11 of hot-air generator 6.

In a first embodiment of hot-air generator 6, the air cooling means 10 comprises an air/air heat exchanger 10 which is completely housed/recessed into the lower supporting base or socle 12 of casing 2, and which is structured so that the moist airflow f arriving from revolving drum 3 and a cold airflow arriving from outside casing 2 can flow through it simultaneously without mixing one another, allowing the cold airflow arriving from outside casing 2 to rapidly cool the moist airflow f arriving from revolving drum 3, so to cause condensation of the surplus moisture inside the airflow f; whereas the air heating means 11 consist in an electrically-powered air heater 11, namely a resistor 11, which is stably located inside of the air duct formed by the basin-shaped half-shell 23 and the rear wall 16 of cabinet 13.

In this embodiment, therefore the air vent 12*a* protruding from the lower supporting base or socle 12 is structured for channeling out of the lower supporting base or socle 12 the cooled dehumidified airflow f produced by the air/air heat exchanger 10 of hot-air generator 6.

Resistor 11 is obviously structured for rapidly heating the dehumidified airflow f coming out from the lower supporting base or socle 12 of casing 2 through air vent 12*a* and directed to the through opening 16*b* on the bottom of the sink-shaped bulge or recess 16*a* of rear wall 16, so that the airflow f going back into revolving drum 3 is rapidly heated to a temperature preferably, though not necessarily, higher than or equal to that of the moist air flowing out of the same revolving drum 3.

In a second embodiment of hot-air generator 6, instead, the air cooling means 10 comprises a first air/refrigerant heat exchanger 10 of a traditional heat-pump apparatus, whereas the air heating means 11 comprises a second air/refrigerant heat exchanger 11 of the same heat-pump apparatus. Both air/refrigerant heat exchangers 10 and 11 are completely housed/recessed into the lower supporting base or socle 12 of casing 2, preferably, though not necessarily, together with the electrically-powered refrigerant compressing device and the refrigerant expansion device of the same heat-pump apparatus.

The first air/refrigerant heat exchanger 10 is structured so that the airflow f arriving from revolving drum 3 and the low-pressure and low-temperature refrigerant directed to the suction of the refrigerant compressing device can flow through it simultaneously, allowing the refrigerant having a temperature lower than that of the airflow f, to absorb heat from the airflow f, thus causing condensation of the surplus moisture in the airflow f.

The second air/refrigerant heat exchanger 11 is structured so that the airflow f directed back into revolving drum 3 and the high-pressure and high-temperature refrigerant arriving from the delivery of the refrigerant compressing device can flow through it simultaneously, allowing the refrigerant having a temperature greater than that of the airflow f to release heat to the airflow f, thus rapidly heating the airflow f to a temperature higher than that of the airflow f coming out of heat exchanger 13, and preferably, though not necessarily, also higher or equal to the temperature of the airflow f coming out of revolving drum 3.

In this second embodiment, therefore, nothing is housed inside the air duct formed by the basin-shaped half-shell 23 and the rear wall 16 of cabinet 13, and the air vent 12*a* protruding from the lower supporting base or socle 12 is structured for channeling out of the lower supporting base or socle 12 the warmed dehumidified airflow f produced in combination by the first and the second air/refrigerant heat exchangers 10 and 11.

General operation of the rotary-drum home laundry drier 1 is clearly inferable from the above description, with no further explanation required.

The advantages connected to the particular structure of the outer boxlike casing 2 are large in number. First of all the mere removal of the rear wall 16 of cabinet 13 grants full access to the whole back of revolving drum 3 without need to disassemble other component of the casing 2, thus greatly simplifying the on-site maintenance of the household appliance.

Moreover, the disassembly of the rear wall 16 of cabinet 13 is really quick to be performed, because it is possible to remove rear wall 16 while leaving everything attached to the latter.

Clearly, changes may be made to the rotary-drum home laundry drier 1 as described herein without, however, departing from the scope of the present invention.

For example, in a different non-shown embodiment the horizontally-oriented front supporting rollers 14 supporting the front end of tubular body 3 may be fixed in free revolving manner directly to the front wall 15 of cabinet 13, whereas the horizontally-oriented rear supporting rollers 14 supporting the rear end of tubular body 3 remain fixed in free revolving manner directly to the top of the supporting base or socle 12.

In a further different non-shown embodiment the circular gasket-supporting collar 21 may be realized in one piece with the basin-shaped lid or cover 20 so as to further speed up the assembly of the rotary-drum home laundry drier 1. Obviously, the circular sealing gasket 19 is still force fitted into the gasket-supporting collar 21 before mechanically fixing to the rear wall 16 of cabinet 13 the basin-shaped lid or cover 20 integrating the collar 21.

The invention claimed is:

1. A rotary-drum laundry dryer comprising:

an outer casing;

a drum structured for housing laundry to be dried and rotatably arranged inside the casing; and a hot-air generator structured to circulate a stream of hot air through the drum, and wherein the outer casing comprises a lower supporting base or socle structured for resting on a floor and an upper cabinet structured for resting on the base or socle and for housing the drum, the drum comprises a substantially cylindrical, rigid tubular body extending inside the upper cabinet above the base or socle, has a front rim rotatably coupled to a front bulkhead of the upper cabinet and a rear rim rotatably coupled to a rear wall of the upper cabinet, and rests on front and rear supporting rollers, the rear wall includes a sink-shaped bulge or recess which projects outwards of the upper cabinet, is roughly centered to the rear rim of the rigid tubular body and includes a through opening, and the upper cabinet comprises a substantially circular, basin-shaped lid or cover fixed to an inner face of the rear wall substantially coaxial to the tubular body, the lid or cover shaped so as to completely cover and close the bulge or recess so as to form, on the rear wall, a cavity in communication with the inside of the drum and in communication with the hot-air generator via the through opening.

2. The rotary-drum laundry dryer of claim 1, wherein the base or socle includes an air vent located below the rear wall and structured for channeling an airflow out of the base or socle, and the upper cabinet comprises a substantially basin-shaped half-shell fixed to an outer face of the rear wall so as to form, together with the rear wall, a connecting duct configured to channel the airflow into the through opening from the air vent.

3. The rotary-drum laundry dryer of claim 1, wherein the hot-air generator is a closed-circuit hot-air generator comprising an air recirculating conduit having two ends connected to the drum on opposite sides thereof, air circulating means located along the air recirculating conduit and structured to produce, inside the air recirculating conduit, an airflow which flows through the drum, air cooling means located along the air recirculating conduit and structured to rapidly cool moist air arriving from the drum so as to cause condensation of surplus moisture inside the moist air, and air heating means located along the air recirculating conduit, downstream of the air cooling means, structured for rapidly heating dehumidified airflow arriving from the air cooling means and directed back to the revolving drum, and at least the air cooling means of the hot air-generator is housed inside the base or socle.

4. The rotary-drum laundry dryer of claim 3, wherein the air heating means is located inside a connecting duct formed by a basin-shaped half-shell and the rear wall or inside the lower supporting base or socle.

5. The rotary-drum laundry dryer of claim 3, wherein the air heating means comprises a resistor located inside of a connecting duct formed by a basin-shaped half-shell and the rear wall.

6. The rotary-drum laundry dryer of claim 1, wherein at least the rear supporting rollers are fixed, in free revolving manner, to the base or socle so that the rear wall is free from any supporting rollers for the drum.

7. The rotary-drum laundry dryer of claim 1, wherein the upper cabinet comprises a first circular sealing gasket interposed between the front rim and a front wall of the cabinet, and a second circular sealing gasket which is interposed between the rear rim and the rear wall.

8. The rotary-drum laundry dryer of claim 7, wherein the upper cabinet also comprises a circular gasket-supporting collar having a nominal diameter greater than that of the rear rim, the collar being fixed to at least one of the rear wall and a periphery of the lid or cover, and the collar being coaxial to the tubular body, and the second circular sealing gasket is force fitted into the collar so as to permanently come in abutment against the periphery of the lid or cover without interruption all around the perimeter.

9. The rotary-drum laundry dryer of claim 1, wherein the bulge or recess is substantially circular in shape, has an outer diameter lower than that of the rear rim, and protrudes outwards of the upper cabinet while remaining substantially coaxial to a longitudinal axis of the tubular body.

10. The rotary-drum laundry dryer of claim 9, wherein the lid or cover is fixed to the rear wall with its concavity directly facing the bottom of the bulge or recess so as to form, on the rear wall, a substantially lenticular-shaped cavity.

11. The rotary-drum laundry dryer of claim 1, wherein the lid or cover is firmly fixed to the rear wall in a substantially airtight manner.

12. The rotary-drum laundry dryer of claim 1, wherein an annular sealing gasket is interposed between the lid or cover and the rear wall.

13. The rotary-drum laundry dryer of claim 1, wherein at least a portion of the lid or cover is permeable to air and configured to permit hot air to flow into or out of the drum.

14. The rotary-drum laundry dryer of claim 13, wherein at least a portion of the lid or cover is perforated.

15. The rotary-drum laundry dryer of claim 1, wherein a central section of the bottom of the lid or cover includes a substantially cup-shaped contra-oriented bulge or recess which projects towards a bottom of the bulge or recess on the rear wall.

16. The rotary-drum laundry dryer of claim 1, wherein a periphery of the lid or cover is fixed to the rear wall by at least one of seam-folding, clinching, riveting, spot-welding, and a fixing technique similar to seam-folding, clinching, riveting or spot-welding.

* * * * *